United States Patent [19]

Resh

[11] Patent Number: 4,689,451

[45] Date of Patent: Aug. 25, 1987

[54] SLOW MAKE AND BREAK ACTION SWITCH

[75] Inventor: John Resh, Valparaiso, Ind.

[73] Assignee: McGill Manufacturing Company, Inc., Valparaiso, Ind.

[21] Appl. No.: 833,956

[22] Filed: Feb. 27, 1986

[51] Int. Cl.[4] ..... H01H 1/18; H01H 13/50; H01H 21/18

[52] U.S. Cl. ..... 200/6 C; 200/DIG. 42; 200/241; 200/248

[58] Field of Search ..... 200/DIG. 42, 1 A, 1 TK, 200/52 R, 239-251, 283, 284, 287, 288, 6 R, 6 B, 6 BA, 6 BB, 6 C, 61.62, 164 R, 164 A, 271, 272, 282

[56] References Cited

U.S. PATENT DOCUMENTS

| | | | |
|---|---|---|---|
| 2,334,769 | 11/1943 | Huetten | 200/248 X |
| 2,611,835 | 9/1952 | Mossman, Sr. | 200/1 TK |
| 2,614,195 | 10/1952 | Kitto | 200/246 X |
| 3,190,995 | 6/1965 | Brown | 200/288 |
| 3,878,344 | 4/1975 | Lockard | 200/241 X |
| 4,074,112 | 2/1978 | Runft | 200/239 X |
| 4,196,328 | 4/1980 | Ishikawa | 200/246 |
| 4,268,726 | 5/1981 | Chu | 200/1 A X |

*Primary Examiner*—J. R. Scott
*Attorney, Agent, or Firm*—Leydig, Voit & Mayer

[57] ABSTRACT

A miniature switch which has reduced susceptibility to welding of contact elements due to high voltage arcing. The switch has parallel resilient spring like current carrying members each having a contact portion mounted adjacent an end thereof. A selectively actuatable switch plunger is adapted to bend the free end of one of the contact members about its fixed support so that the contact portion thereof contacts the contact portion of the other current carrying member, which in turn bends about its fixed support. Upon removal of the operating force of the plunger, the current carrying members spring back to their normal horizontal positions, breaking the electrical contact between the contact portions. The making and breaking actions are made in a slow manner so that the possibility of bouncing between contact elements and the consequent welding due to high voltage arcing, is greatly reduced. By virtue of the mode of actuation, the contact portions of the current carrying members are moved in different arcuate paths during the switching operation so as to provide a wiping action therebetween at the surfaces of contact, which further resist the formation of welds between the contact elements. Auxiliary resilient spring members also are provided adjacent to the current carrying members, so as to provide a force that constantly opposes proximate contact between the contact elements and prevents prolonged build up of welding action.

15 Claims, 10 Drawing Figures

SLOW MAKE AND BREAK ACTION SWITCH

FIELD OF THE INVENTION

The present invention relates generally to electrical switches, and more particularly, to an improved miniature switch or microswitch having a switching action with reduced contact bouncing.

BACKGROUND OF THE INVENTION

A variety of microswitches currently are available depending upon the application and the specific switching action desired. Snap action microswitches, in particular, are well suited to applications where short and positive switching action is desired and are commonly used in a long list of electrical appliances including food processors, microwave ovens, vending machines, record players, timers, counters, thermostatically controlled equipment, photocopiers and the like. The snap action type of microswitch functions well in such appliances as long as current surge suppressant circuity is provided within the appliances. For instance, conventional microwave ovens generally have a built-in electronic circuit that suppresses transformer current surges that can be produced by the switching action, especially with inductive loads and higher operating voltages. By virtue of the snap action operation of such microswitches, a bouncing motion typically is created between the contact elements of the current carrying members at moments when the switch is activated as well as deactivated. This bouncing action, which is more pronounced in applications for switches which do not have stable mountings, or which are utilized in portable or in moving equipment, can create a high voltage arc between the contact elements which, in the absence of surge suppressant circuitry, can cause the contact elements to be welded together resulting in a permanent shorting of the switch elements, thereby defeating the very purpose of the microswitch. With the increasing trend towards dispensing with the additional expense of protective circuits in order to cater to the competitive consumer appliance market, there is a need for a switch which overcomes the arcing problem faced by conventional microswitches when operating without current surge suppressor circuits.

SUMMARY OF THE INVENTION

Accordingly, it is a primary object of the invention to provide an improved microswitch that is less susceptible to fusion of its contact elements due to high voltage arcing.

Another object is to provide a switch as characterized above that has a slow make and break switching action that minimizes bouncing and disturbance between contact elements during actuation and deactuation.

A further object of the invention is to provide a microswitch of the above kind which provides reliable contact force with a minimal operating force.

Yet another object is to provide a switch of the foregoing type in which fatigue of the switch operating mechanism is reduced and the necessity for replacement and maintenance is minimized.

Still a further object is to provide a microswitch of the above kind in a form which has a minimal number of mechanical parts, is easy and reliable to operate, and may be manufactured economically using conventional snap action switch housings.

These objects are achieved in a switch according to the present invention by the provision of a smoother and slower motion of the current carrying members when they are being forced into contact with each other, as well as when they are being forced apart in order to break contact. The microswitch, according to an illustrated embodiment, uses flexible upper and lower current carrying members having contact elements on their opposed faces. The members are mounted in a parallel relation to each other with the contact elements thereof facing each other, normally separated by an air gap. When an external force is applied through an operating plunger to one of the members, it is forced along an arc and slowly brought into contact with the other member, which in turn is forced along a different arc as a result of the contacting force. The current carrying members comprise resilient spring-like blades so that upon removal of the external operating force upon deactuation of the operating plunger, the current carrying members spring back under their resiliency to their normal separated positions. To enhance reliable separation of the contact elements, auxiliary leaf springs are provided adjacent opposed facing surfaces of the current carrying members. The above arrangement has been found to provide a smooth and slow making and breaking of switch contact without bouncing or undesirable disturbance of the contact elements. In addition, the different arc paths of movement for the current carrying members provides a wiping action that resists the initial occurrence of welding between the contact elements.

Since the external switching force is applied directly to the contact carrying portions of one of the current carrying members the required operating force is considerably less than that in the prior snap action switches, and the contact itself is with greater force and is more secure. In addition, the current carrying members undergo reduced stress change during their operation, which contributes to extended life and reduced maintenance for the switch mechanism. These characteristics, in combination with the prevention of bouncing affects, make the present switch applicable in a wide range of applications and also provide the benefits of longer life and greater current carrying capacity for the switch.

BRIEF DESCRIPTION OF THE DRAWINGS

For the purpose of facilitating an understanding of the invention, the accompanying drawings illustrate a preferred embodiment. The above and other objects of the invention, as well as the features thereof, will become more apparent from the following description when taken in conjunction with the accompanying drawings.

DESCRIPTION OF PREFERRED EMBODIMENTS

Figure 1:
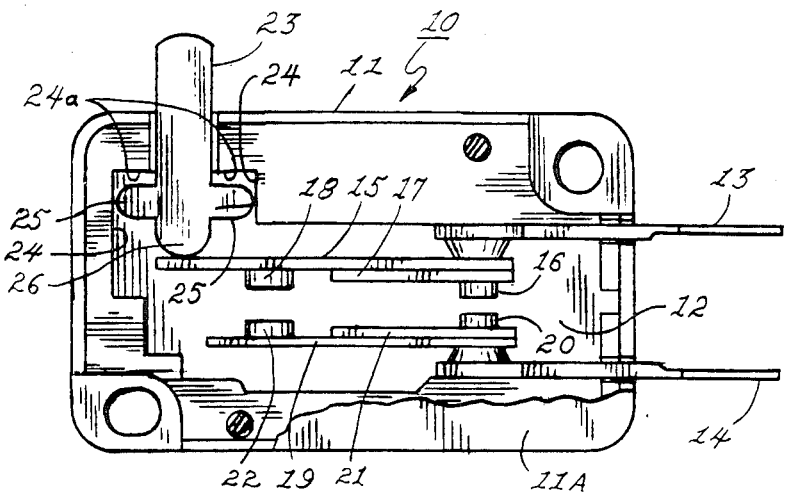
FIG. 1 is a side view of a slow make and break microswitch according to the present invention, with the cover thereof cut away to show the mounting for the current carrying members.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Figure 2:
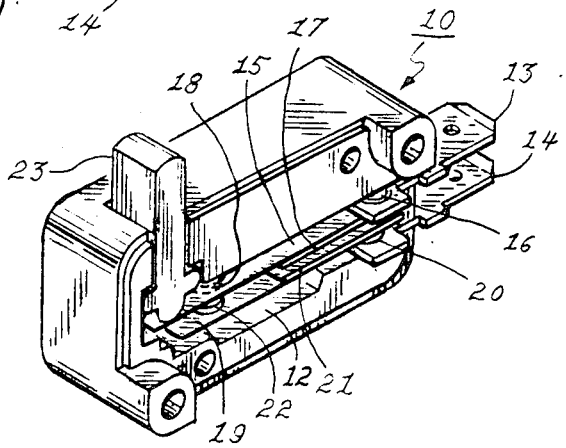
FIG. 2 is a perspective view of the illustrated switch with the cover removed.

Referring now more particularly to FIGS. 1 and 2 of the drawings, there is shown an illustrative switch 10 embodying the present invention, comprising a housing 11 made of insulating material and formed with an internal cavity 12 that houses the operating mechanism of the switch. A pair of metallic terminals 13, 14 project in fixed relation from one end of the housing. The terminal 13 in this instance has a current carrying member 15 fixed to the inner end thereof on a surface facing the terminal 14. The current carrying member 15 is coupled to the terminal 13 by means of a rivet 16, which in turns affixes the terminal 13 to the housing. The terminal 14 similarly has a current carrying member 19 affixed to an innermost end thereof by means of a rivet 20. The current carrying members 15, 19 are thereby normally supported in parallel relation to each other, and each current carrying member has a respective contact element 18, 22 mounted adjacent an inwardly extending end of the current carrying member in direct opposing relation to each other, separated by a predetermined distance. When the switch is in its normally opened position, as shown in FIG. 1, the separation between the contact elements 18, 22, prevents the establishment of an electrical path between the terminals 13 and 14.

In order to selectively establish electrical conductive contact between the terminals 13, 14, an operating button or plunger 23 is provided. The plunger has a contoured or rounded contact portion 26 adapted, in this case, for engaging the current carrying member 15 of the terminal 13 and is positionable between an upwardly extended inactive position, as viewed in FIG. 1, and a downwardly depressed actuating position, as viewed in FIG. 3. For guiding movement of the plunger relative to the housing, the housing is formed with a slot 24 within which opposed arms 25 of the plunger ride.

In accordance with the invention, the current carrying members are made of resilient spring metal, and upon actuation and deactuation of the switch plunger, are adapted to effect relatively slow making and breaking of the terminal contacts in the manner which both minimizes contact bounce and prevents and resists undesirable loading and welding of the contacts. To this end, the current carrying member 15 is of longer length than the current carrying member 19 and the contoured contact portion 26 of the plunger 23 engages the current carrying member 15 at a point adjacent the free terminal end thereof. When the plunger is in its released or unactuated position, as viewed in FIG. 1, the plunger preferably is held in lightly biased relation between the end of the current carrying member 15 and a stop surface **24*a* of the slot 24**.

Figure 3:
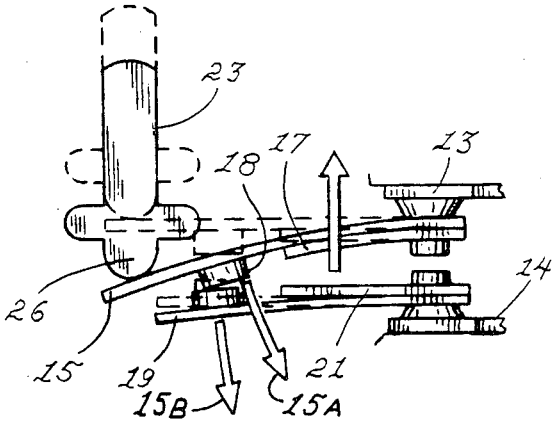
FIG. 3 is a fragmentary view of the current carrying elements of the illustrated switch showing the current carrying members being moved from an open separated position to a closed position along different arcs of motion.
Figure 4:
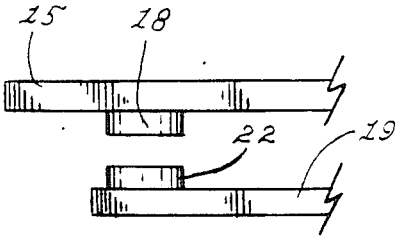
FIG. 4 is a fragmentary illustration of the current carrying elements in their switch open position.

When the plunger 23 is depressed, the contact portion 26 presses the resilient current carrying member 15 downwardly, as viewed in FIG. 3, along an arc so that the contact element 18 engages the contact element 22. As downward motion of the plunger is continued, the pressure of the plunger contact portion 26 on the upper current carrying member 15 is transmitted through the contact element 18 to the contact element 22 so that the lower current carrying member 19 also bends downwardly and along an arc away from its normal horizontal position. By such movement, the contact between the two contact elements 18, 22 is established in a slow and steady manner, without sudden jerks or snappy motion, thereby greatly reducing the possibility of bouncing and the consequent welding action between contact elements.

The material and thickness of the current carrying members 15, 19 may be chosen so as to permit relatively easy deformation of the current carrying members 15, 19, and reliable return of the current carrying members to their normal parallel positions upon release of the plunger. During the return movement of the current carrying member 15, the plunger 23 also is forced to its original raised position, as viewed in FIG. 1. It will be understood by those skilled in the art that the choice of material for the current carrying members 15, 19 may be made from a large variety of conductive metals and is governed by the required current carrying capacity and the resiliency necessary to achieve a slow and steady closing and opening of the contacts.

In further carrying out the invention, a pair of separate leaf springs 17, 21 are mounted in adjacent relation to respective opposing surfaces of the current carrying members 15, 19 for defining and maintaining the normal parallel relationship of the current carrying members, for controlling the operating force required to actuate the switch, and for enhancing reliable separation of the contact elements 18, 22 upon deactuation of the switch. The leaf springs 17, 21 in this instance are elongated in form and each are affixed at one end between the respective rivet 16, 20 and the immediately adjacent end of the current carrying member 15, 19. The inwardly extending ends of the leaf springs 17, 21, tend to maintain the current carrying members 15, 19 in parallel separated relation with the contact elements 18, 22 in spaced relation to each other even when the switch is utilized in portable applications or other environments in which it is subjected to vibratory or moderate shock conditions. Upon actuation of the switch, the current carrying member is moved under the influence of the plunger against it's own resilience, as well as the resilience of the leaf spring 17, resulting in more reliable and smooth movement of the contact element 18 as it is brought into contact with the contact element 22, thereby minimizing bouncing and possible high voltage arcing between the contacts and welding thereof.

Figure 5A:
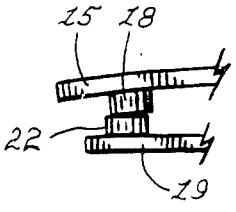
FIGS. 5*a*–5*c* are fragmentary illustrations showing the relative motion between the surfaces of the contact elements as the switch closing action progresses.
Figure 5B:
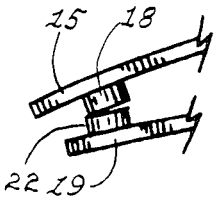
Figure 5C:
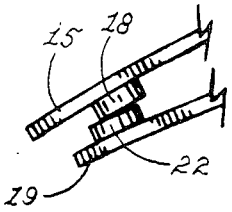

In accordance with a further feature of the invention, in order to further resist the formations of undesirable welds between the contact elements during actuation and deactuation of the switch, the contact elements are adapted for movement in a wiping fashion relative to each other during both the making and breaking actions of the switch. In the illustrated embodiment, this is accomplished by mounting the contact elements on the current carrying members for movement in substantially different arcuate paths. To this end, the illustrated current carrying members are mounted in parallel cantilever fashion from respective spaced mounting points, and upon activation of the operating plunger, one of the current carrying members is first engaged and bent about its mounting point to a position that engages and bends the other current carrying member about its respective mounting point. Hence, when the plunger 23 depresses the end of the upper current carrying member 15 it can be seen that it causes the contact element 18 of the current carrying member 15 to be moved downwardly along an arc 15A (FIG. 3), and upon engagement with the contact element 22, further downward movement causes the contact element 22 to be moved in a substantially different arc 15B as the lower current carrying member bends downwardly. This effectively causes relative movement between the engaged surfaces of the contact elements 18, 22, resulting in a wiping action between the contact elements, as illustrated in FIGS. 5*a–c*. Such wiping action of the contact elements 18, 22 occurs during both actuation and deactuation of the switch, serving to resist the formation of welds between contact elements when electrical contact is both established and broken.

Figure 6:
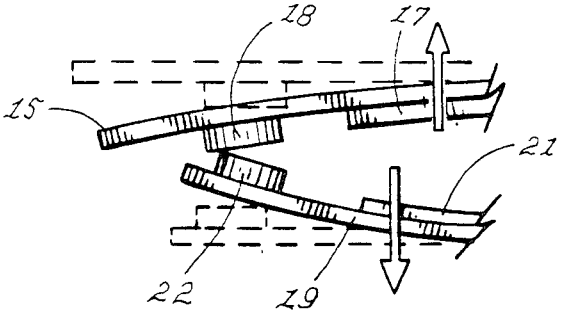
FIG. 6 is a fragmentary illustration showing the separating forces acting on the contact elements of the switch in the event welding is initiated during switch opening.

Protection against welding of the contact elements due to high voltage arcing is further prevented during deactuation of the switch by the effect of the leaf springs 17, 21. Upon release of the plunger during deactuation of the switch, if any voltage arching should occur between the contact elements 18, 22, initiation of welding between the contact elements will be interrupted by the further separating forces acting on the current carrying members 15, 19 by the leaf springs 17, 21. For example, in the event that welding between the contacts 18, 22 is initiated so that the lower current carrying member 19 is lifted upwardly beyond it's normal horizontal position by virtue of the continuing contact between the contact elements 18, 22 as illustrated in FIG. 6, it can be seen that the contact elements 18, 22 are urged in separating relation both by the resilient forces of the current carrying members 15, 19 and both leaf springs 17, 21 thereby preventing the build up of welding action between the contact elements.

It will further be appreciated that the switch 10 of the present invention can be operated with relatively small plunger actuating forces, but yet achieves relatively high contact forces between the switch contact elements 18, 22. When an external force is applied to the plunger 23, electrical contact between the contact elements 18, 22 is established against the resiliency of the current carrying members 15, 19 and the leaf spring 17, which undergo relatively small stress changes, and hence, only a relatively light operating force of the switch plunger is required. Since the force transfer between the upper current carrying member 15 and lower current carrying member 19 is effected entirely through the contact elements 18, 22, relatively high contact force between such elements is effected. Such high contact forces prevent vibration of the contact elements so as to enable to switch to withstand shock loads that might otherwise break the electrical and mechanical contact between the elements. The current carrying capacity or the electric rating of the switch, which depends on various factors including the contact force, is thereby augmented.

Figure 8:
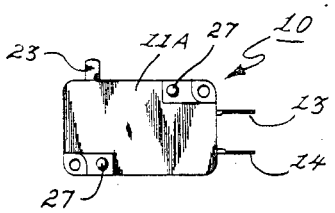
FIG. 8 is a plan view, substantially in actual size, of the illustrative switch in fully assembled condition.
Figure 7:
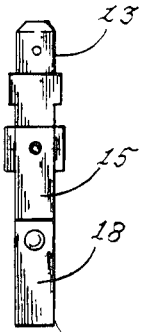
FIG. 7 is a front view of one of the switch terminals assemblies.

The switch operating mechanism of the present invention is not only of relatively simple and economical construction, but is adaptable for mounting in many conventional switch housings. The switch housing shown in FIGS. 1 and 2 is of a type commonly used for conventional plunger actuated snap action microswitches. The plunger 23 and corresponding housing retention slot 24 are also conventional, as is the arrangement for anchoring the terminals 13 and 14 in position within the housing. The slow make and break mechanism of the switch is adapted to be easily assembled for use with such housings. Specifically, the current terminal 13, the leaf spring 17 and the corresponding upper current carrying member or spring blade 15 are first preassembled in the form of a separate terminal assembly, as shown in FIG. 7. Similarly, the current terminal 14, the leaf spring 21 and the corresponding lower current carrying member or spring blade 19 are preassembled as another separate terminal assembly. The two terminal assemblies are then positioned into the switch housing 11 by anchoring the terminals at their respective locations within the housing. As described above, the separation between the contact elements and the desired operating force may be controlled by choice of the leaf springs. After the plunger is placed within the corresponding retention slot on the housing, the miniature switch assembly is completed by fixing the switch cover 11A over the switch housing by the use of a pair of rivets 27. Such a completely assembled miniature switch 10 is shown in FIG. 8, substantially in actual size.

From the foregoing, it can be seen that the miniature switch of the present invention provides efficient electrical switching and is significantly less susceptible to welding of contact elements due to high voltage arcing by the provision of a smoother and slower making and breaking action. Since the establishment of electrical contact is dependent upon the resiliency of the flexible current carrying members, reliable control is possible with a relatively light operating force. Correspondingly, the small stress change by the flexible members, as a result of the switch operating action, greatly reduces the metal fatigue factor leading to prolonged life of the slow make and break mechanism. Control over the separation between contact elements, the operating force, and current carrying capacity is possible by varying the thickness and material of the current carrying members and the leaf spring members. In addition, the switch provides ease of assembly and adaptability to conventional switch housings.

I claim as my invention:

1. A slow make and break action electric switch comprising a switch housing, a pair of resilient current carrying members each having a contact portion on one end thereof, means supporting the other end of each of said current carrying members in said housing so that said members are normally parallel to each other with said contact portions facing each other in spaced apart relation, selectively actuatable plunger means supported in said housing for relative movement, said plunger means being actuatable for engaging and bending one of said current carrying members about its supported end such that the contact portion of said one current carrying member engages the contact portion of the other current carrying member which in turn causes bending of said other current carrying member about its supported end, said current carrying members being capable of returning to their normal parallel positions upon deactuation of said plunger means, and said current carrying members each having an auxiliary resilient spring member mounted on a respective opposing face thereof for opposing inward movement of unsupported ends of the current carrying members relative to each other so that upon actuation of said plunger means said contact portions can be slowly brought into reliable electric contact with each other without substantial bounce and upon deactuation of said plunger means said current carrying members are urged into separated relation.

2. The electric switch of claim 1 in which one of said current carrying members is longer in length than the other current carrying member and has a free end portion extending outwardly beyond the free end of the other current carrying member, and said plunger means is engageable with the outwardly extending free end portion of the longer current carrying member.

3. The electric switch of claim 1 wherein one of said current carrying members is longer than the other current carrying member, and said plunger means is directly engagable with the longer of said current carrying members.

4. The electric switch of claim 1 in which plunger means is operable for bending said current carrying members so that said contact portions are moved in different arcuate paths while in contact.

5. The electric switch of claim 1 in which said auxiliary spring members each are shorter in length than the respective current carrying member.

6. A slow make and break electric switch comprising a housing member defining an internal chamber, a pair of resilient current carrying members disposed in said housing chamber and each having a contact portion on one end, means supporting the other ends of said current carrying members in said housing chamber so that the current carrying members are in normally parallel spaced relation to each other with said contact portions facing each other, a terminal member associated with each said current carrying member, said terminal members extending outwardly of said housing member in parallel fashion, each said current carrying member and its associated terminal member being coupled to each other and to said housing member by a common fastening means, a cover plate mounted on said housing member for enclosing said chamber, a selectively actuatable plunger mounted for relative movement in said housing member for applying an operating force to the contact portion end of one of said current carrying members in a switch operation so that said contact portions are slowly brought into contact with each other and the current carrying members are depressed away from thier normal parallel spaced relation, and upon deactuation of said plunger said current carrying members being operaable for returning to their normal parallel spaced apart relation with the contact portions thereof being slowly separated from contact with each other.

7. The electric switch of claim 6 including a pair of auxiliary resilient spring members each supported adjacent a respective one of said current carrying members, said auxiliary spring members being operable for opposing relative inward movement of contact portion ends of said current carrying members whereby upon deactuation of said plunger the current carrying members are reliably returned to their normally spaced apart relation.

8. The electric switch of claim 6 in which said current carrying members each are made of resilient spring material.

9. The electric switch of claim 6 in which upon actuation of said plunger said plunger engages and bends one of said current carrying members about its supported end such that the contact portion of said current carrying member engages the contact portion of the other current carrying member which in turn causes bending of said other current carrying member about its supported end.

10. The electric switch of claim 6 wherein one of said current carrying members is longer than the other current carrying member, and upon actuation of said plunger said plunger engages and bends the end of said longer current carrying member such that the contact portion of said current carrying member engages a contact portion of the other current carrying member which in turn causes bending of said other current carrying member about its supported end.

11. The electric switch of claim 10 in which said plunger is operable for bending said current carrying members so that said contact portions are moved in different arcuate paths while in contact.

12. The electric switch of claim 1 in which said current carrying members each have an auxiliary resilient spring mounted in adjacent normally parallel relation thereto for opposing inward movement of the ends of the current carrying members relative to each other, said auxiliary spring members each being shorter in length than the respective current carrying member.

13. The electric switch of claim 12 in which said auxiliary spring members are mounted on respective opposing faces of said current carrying members.

14. The electric switch of claim 1 in which said housing member is rectangular configured with a relatively narrow thickness so as to define rectangular side faces on opposed sides thereof and a plurality of relatively narrow width end faces about the perimeter of said side faces, said internal chamber being formed in one of said side faces, said cover plate being mounted on said one side face, and said housing member further being formed with an opening in one of said end faces for supporting said plunger and guiding movement thereof relative to said housing member.

15. The electric switch of claim 14 in which said current carrying members and terminal members are disposed in parallel relation to the longitudinal axis of said rectangular configured housing member, and said plunger is mounted for movement transverse to the longitudinal axis of said rectangular configured housing member.

* * * * *